United States Patent [19]

Rommel

[11] Patent Number: 4,671,161

[45] Date of Patent: Jun. 9, 1987

[54] ACTUATING MECHANISM FOR A COCKING DEVICE

[75] Inventor: Emil Rommel, Oberndorf, Fed. Rep. of Germany

[73] Assignee: Heckler & Koch GmbH, Oberndorf, Fed. Rep. of Germany

[21] Appl. No.: 821,986

[22] Filed: Jan. 22, 1986

[30] Foreign Application Priority Data

Feb. 1, 1985 [DE] Fed. Rep. of Germany ..... 3503322

[51] Int. Cl.[4] ..... F41C 19/16

[52] U.S. Cl. ..... 89/1.4; 89/147

[58] Field of Search ..... 89/1.4, 147; 42/16; 74/84 R

[56] References Cited

U.S. PATENT DOCUMENTS

| | | | |
|---|---|---|---|
| 2,104,033 | 1/1938 | Green | 89/1.4 |
| 2,389,737 | 11/1945 | Neuschotz | 89/1.4 X |
| 2,418,906 | 4/1947 | Sampson et al. | 42/16 |
| 2,966,830 | 1/1961 | Hepperle | 89/155 |
| 3,386,336 | 6/1968 | Roy | 89/1.4 X |

FOREIGN PATENT DOCUMENTS

| | | |
|---|---|---|
| 10092 | 7/1880 | Fed. Rep. of Germany . |
| 65980 | 12/1892 | Fed. Rep. of Germany . |
| 388974 | 1/1924 | Fed. Rep. of Germany . |
| 2522359 | 11/1976 | Fed. Rep. of Germany . |

*Primary Examiner*—David H. Brown
*Attorney, Agent, or Firm*—Erwin S. Teltscher

[57] ABSTRACT

Actuating mechanism for the cocking device of a self-loading hand gun which has an actuating element, wherein two co-acting elements for limiting rotational movement of the actuating element are provided to stop movement of the actuating element after a predetermined angle of rotation, wherein one co-acting element is connected in driving relationship with the actuating element, while the other co-acting element is secured against rotation, wherein the co-acting elements include a guide cam for coaction with forward and rear arms of a lever, and wherein the lever pivots about an axis movable along a circular path, wherein the guide cam includes a first portion forming a stop for the forward lever arm, as viewed in a predetermined sense of rotation, when the forward lever arm has moved past the predetermined angle of rotation, and a second portion spaced at a certain angular distance from the first portion along opposite rotation sense, wherein the second portion comes into contact with the rear lever arm so as to pivot the rear lever arm in one direction, when the lever is moved in a reverse rotation sense from a starting position in which the forward lever arm rests against the first portion, so that the forward lever arm is subsequently moved in an opposite direction by a distance sufficient to enable the lever to be moved past the first stop in the predetermined sense of rotation.

7 Claims, 4 Drawing Figures

ACTUATING MECHANISM FOR A COCKING DEVICE

BACKGROUND OF THE INVENTION

The present invention relates to an actuating device for the cocking device of a self-loading hand gun.

In known guns of this type, including in particular rifles, cocking is effected by a linear movement of a component of the gun. In this arrangement, the component of the gun so moved can be displaced in one direction only, starting from the ready-to-fire position.

SUMMARY OF THE INVENTION

The present invention has for its object to provide a simple and reliably operating actuating device that does without any linear movement.

This object is achieved according to the invention by an arrangement in which an actuating element is rotatably seated, in which a device for limiting the rotational movement is provided for stopping the actuating element after a pre-determined angle of rotation when being moved by hand in a pre-determined direction, in which the device comprises a guide cam for coaction with the two arms of a two-armed lever arranged to pivot about an axis which moves along a circular path during rotation of the actuating element, and in which the design of the guide cam and the two-armed lever is such that when one of the arms of the lever comes to rest against the stop of the guide cam during the aforesaid rotation in the pre-determined sense thereby blocking any further rotation in the same sense, the lever is pivoted by a reverse motion resulting from the coaction between the other arm of the lever and the guide cam so that it can be moved past the stop in the pre-determined sense of rotation. The two-armed lever is not seated almost free from friction in this case, but can be pivoted only when a pre-determined torque is applied. To achieve this, the lever may either be a little tight due to frictional forces, or may be retained in its different positions by click-stop means.

The advantage of this invention lies in the fact that it is ensured that, starting from the rest position, the actuating element can be rotated in one pre-determined sense only, and this inspite of the fact that when several cocking operations are performed in series, the actuating element is always rotated in the same sense (except for a slight reverse movement necessary for releasing the blocked rotary movement) and is never moved in the reserve sense over larger rotary angles, neither by hand nor by the action of a spring. Considering that it is not possible in this arrangement to provide a fixed stop delimiting the movement as in the case of a cocking device moving in the linear sense, it is of advantage that when the device has been rotated by a pre-determined angle of rotation, after which the cocking process is completed, any further unwanted rotation is nevertheless prevented by a stop. Turning the actuating element slightly in the reverse sense, after the stop has been reached, permits the shooter to perform the next cocking operation by turning the device in the predetermined sense. Another advantage of the invention resides in the fact that it is particularly easy to mount a rotatable actuating element for the cocking device in dust-tight and humidity-tight relation in the housing accommodating the mechanism of the weapon. Further, it is an advantage of the invention that there is no need for a separate spring ensuring that a component coacting with the guide cam is constantly in contact with the latter. This increases the operating safety of the weapon. The before-mentioned somewhat tight seat of the two-armed lever can be realized in a simple manner, for example by the engagement of a somewhat resilient pivot pin in a corresponding bore. The pivoting movement of the two-armed lever merely has to be counteracted a little by frictional or similar forces in such a manner that the lever cannot change its position accidentally during execution of the cocking process.

The manner in which the rotatable actuating element is connected with the mechanism of the weapon is not contemplated by the invention. It is, however, well imaginable that a driving connection between the rotatable actuating element and the cocking mechanism of a conventional weapon, which moves in the linear sense, may be realized by suitable transmission means.

According to one embodiment of the invention it is provided that the guide cam comprises an inwardly protruding first portion forming a stop for the forward lever arm—viewed in the pre-determined sense of rotation—, when it has passed the pre-determined angle of rotation, that an inwardly protruding second portion is provided at a certain distance from the first portion of the guide cam which gets into contact with the rear lever arm to pivot it outwardly when the lever is moved in the reverse sense relative to the guide cam—starting from the position in which the forward lever arm rests against the said first portion—so that the forward lever arm is moved inwardly by a distance sufficient to prevent the first portion from acting as a stop in the predetermined sense of rotation, and that one of the two coacting elements (guide cam or two-armed lever with its axis) of the device for delimiting the rotary movement is connected in driving relationship with the actuating element while the other one of the two elements (two-armed lever with its axis or guide cam) is fixed against rotation. The simple design constitutes an advantage of the invention.

One embodiment of the invention provides that the guide cam comprises at least one additional inwardly protruding portion forming a stop for preventing the two-armed lever from moving in the reverse direction.

This embodiment is of advantage where it is intended to ensure that when the actuating element has effected part of its rotary movement, it can be turned back either not at all or at best to the before-mentioned stop. The driving connection between the actuating element and the part carrying the two-armed lever may be realized in any desired manner. In one embodiment of the invention, the path of the axis of the two-armed lever is arranged concentrically with the axis of the actuating element. This offers the advantage of a particularly space-saving design. According to one embodiment of the invention, the two-armed lever is seated preferably on a part which is connected with the actuating element to rotate with the latter. In this case, no movable connecting parts are required between the actuating element and the seating point of the lever.

The invention can be realized in a particularly simple manner when the pre-determined angle of rotation is fixed at a maximum of approximatively 360°. Depending on the transmission ratio between the actuating element and the mechanism of the weapon, a smaller angle may also be sufficient in some cases, for example an angle of 180°. It is also possible to provide stops for blocking the rotary motion in the predetermined sense of rotation at equal or unequal angular spacings giving together a sum of 360°, and if desired one or more stops blocking the rotary motion in the reverse sense may also be provided.

BRIEF DESCRIPTION OF THE DRAWINGS

Additional features and advantages of the invention will become apparent from the following description of one embodiment of the invention with reference to the drawing which shows essential details of the invention, and from the claims. The individual features may be realized in any embodiment of the invention either alone or in any desired combination. In the drawing:

DESCRIPTION OF THE PREFERRED EMBODIMENT

The figures show only those details which are necessary for explaining how the rotary movement is limited. Any details of the weapon or of the cocking device not necessary for the understanding of this arrangement have been omitted.

Figure 1:
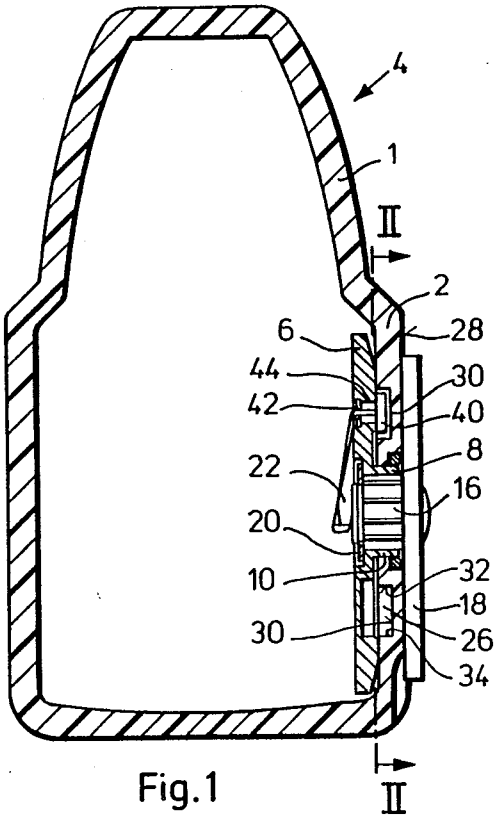
FIG. 1 is a cross-sectional view of the housing of an automatic rifle showing only those parts which are essential for the understanding of the invention.

In FIG. 1, a side wall 2 of a plastic housing 4 of an automatic rifle carries on its inner face a disc 6 provided with a tubular projection 8 engaging a bore 10 in the side wall 2. An internal toothing 12 of the disc 6 engages an outer toothing 14 of a bolt 16 to rotate with the latter. The bolt 16 is formed integrally with an actuating element the cocking device which will be described hereafter as rotary knob 18. A spring washer 20 retains the bolt 16 in engagement with the disc 6. FIG. 1 shows the arrangement viewed from the forward to the rear end of the rifle so that the side wall 2 is in reality the left side wall of the housing 4.

When the rotary knob 18 is turned, a projection 22 arranged on the inner face of the disc 6 moves additional parts of the weapon in order to perform the cocking process. This operation is necessary in order to bring the first cartridge into the chamber when the weapon is still empty, to unload any cartridge that may still be left in the chamber after the magazine has been removed and, in case of trouble, to remove an unfired cartridge from the weapon and feed another cartridge from the magazine into the chamber.

Figure 2:
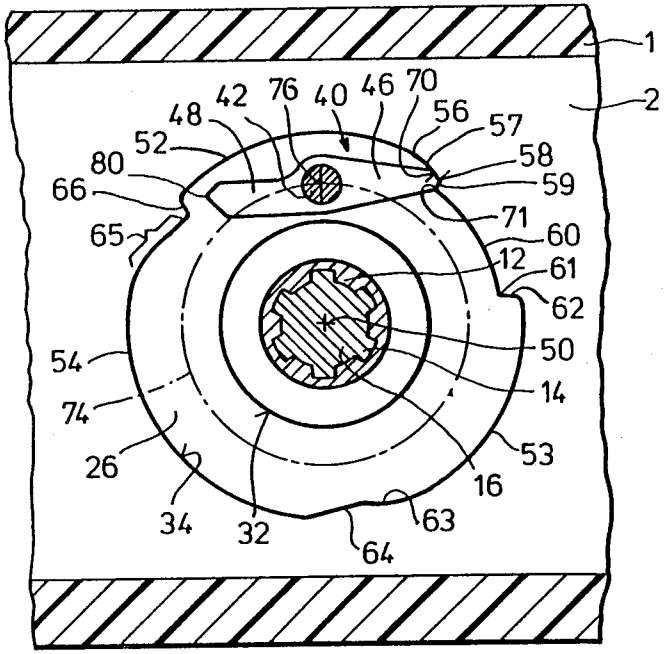
FIG. 2 shows a sectional view taken along line II—II in FIG. 1, showing the actuating element in the position in which it has just been stopped by a stop after execution of a full rotation.
Figure 3:
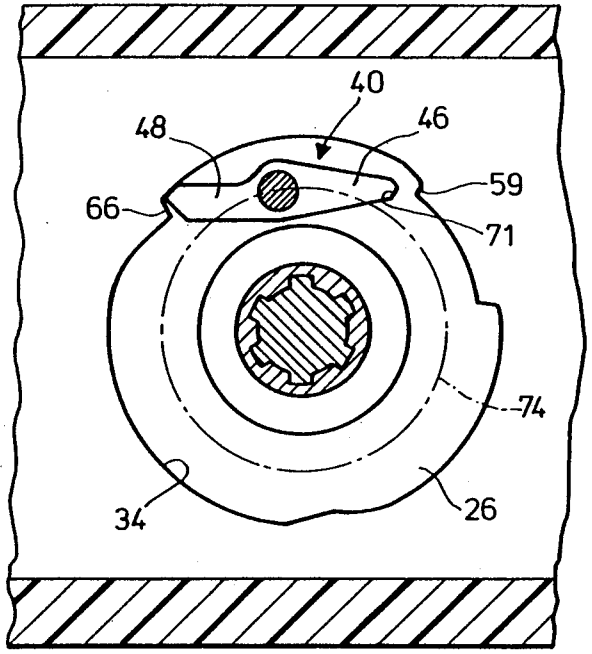
FIG. 3 shows a representation similar to that of FIG. 2, but with the actuating element slightly turned back in counter-clockwise direction relative to the representation of FIG. 2.

In the embodiment shown it is assumed that for performing a cocking process the rotary knob 18 must be rotated by 360° in counter-clockwise direction (viewed from the right in FIG. 1) or—in the representation of FIG. 2—in a clockwise direction. Given the fact that to this end the rotary, knob 18 has to be rotated initially by a few degrees in a counter-clockwise direction, as viewed in FIG. 3, to bring it into the position shown in FIG. 3 and to pivot the lever 40 which will be described in detail hereafter, the angle of rotation to be passed in a clockwise direction from the position shown in FIG. 3 to the next stop in the position shown in FIG. 2 is by a few degrees greater than 360°. In addition, separate locking means preventing any reverse motion are to be provided after a rotary angle ofabout 120° (starting out from the position shown in FIG. 2). Locking means of this type may be convenient in cases where the shooter interrupts the rotary movement of the rotary knob in this position for some reason, for example for the purpose of having a look at the chamber which is now open for inspection. This arrangement is intended to ensure that the shooter, after having completed his inspection, will not turn the knob 18 back erroneously, instead of turning it further by approximatively 240° as would be necessary for the correct execution of the cocking process. In the supposed case, the locking means preventing the rotary knob 18 from being turned back may be necessary in particular when a spring, for example the return spring of a gas-operated loader, is tensioned and might tend to turn the rotary knob back when the latter is released. Finally, the free rotation of the knob in the counter-clockwise direction, starting out from FIG. 2, is to be rendered impossible.

The inner face of the side wall 2 is provided with a substantially annular recessed groove 26 which is delimited by a bottom face 30 extending in parallel to the outer face 28 of the side wall 2, a cylindrical inner face 32 which performs no function in the embodiment shown, and an outer face forming the guide cam 34.

The face of the disc 6 adjacent the side wall 2 carries a two-armed lever 40 comprising a slotted journal pin 42 engaging a bore 44 in the disc 6 whereby it is permitted to rotate in the bore 44 against the action of certain frictional forces so that the lever 40 will stay in any position. The lever comprises a forward lever arm 46, related to the rotary movement in clockwise direction required for the cocking process (as shown in FIG. 2) and a rear lever arm 48. The lever 40 is made from a plastic material. The expressions clockwise and counter clockwise direction as used hereafter are always related to the representation of FIGS. 2 to 4.

The guide cam 34 comprises several sections 52, 53 and 54 of equal radius which are arranged concentrically relative to the axis 50 of the rotary knob 18 and the disc 6 and which form the radially outermost portions of the guide cam 34. A point 56 at the right end of the concentrical portion 52—as viewed in FIG. 2—defines the beginning of a concavely curved and inwardly extending (i.e. towards a smaller distance from the axis 50) portion 57 which finally forms a bend 58 and ends in a portion 59 extending in a nearly radial direction towards the axis 50. The last-mentioned portion 59 is followed in the clockwise direction by a concentrical portion 60 having a length corresponding to approximatively half the length of the lever 40. The end 61 of the concentrical portion 60 is followed by a section 62 extending substantially radially outwardly and forming the transition to the concentrical portion 53. The concentrical portions 53 and 54 include between them a portion 63 which extends slightly inwardly and a portion 64 following the latter and extending slightly outwardly. The end of the concentrical portion 54 is followed by a concavely curved section 65 which extends relatively far inwardly and which is followed in turn by an outwardly directed section 66 establishing the connection with the concentrical portion 52.

Figure 4:
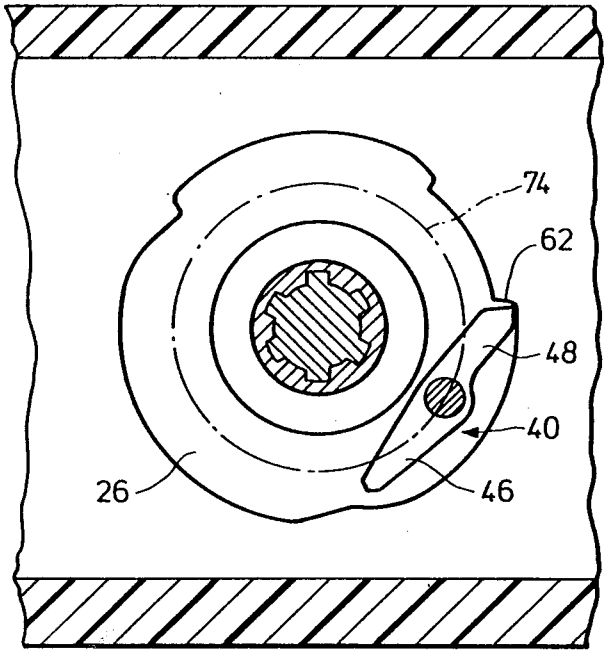
FIG. 4 shows a representation of the arrangement similar to that shown in FIG. 2, where the reverse motion of the actuating element has been blocked after execution of a rotary movement by about 120°.

The forward lever arm 46 has a somewhat pointed shape defined by two faces 70 and 71. In the representation shown in FIG. 2, the edge formed between these two faces 70 and 71 fits exactly into the bend 58. If a tangent to the circular path 74 of the axis 76 of the pin 42 was drawn through the point where the pin 42 is positioned in FIG. 2, it would intersect also substantially the bend 58. Now, if one tries to rotate the rotary knob 18 in clockwise direction, the forward end of the lever arm 46 formed by the faces 70 and 71 cannot get free of the stop formed in the area of the bend 58 by the sections 57 and 59. This prevents the rotary knob 18 safely from being turned in clockwise direction. This is the position which the rotary knob 18 assumes after having performed a full rotation. For the purpose of performing another cocking operating, the shooter has to turn the rotary knob 18 first a short way in counter-clockwise direction so that the rear end 80 of the rear lever arm 48 is brought into contact with the section 66 of the guide cam 34. Giving due regard to the direction in which the rear end 80 moves at the moment when it comes into contact with the section 66, and giving further due consideration to the position of the axis 76 of the pin 42 relative to the edge-shaped rear end 80, the section 66 is inclined in such a manner that the rear end 80 will slide outwardly along the section 66 so that the lever 40 is pivoted thereby in clockwise direction relative to the disc 6; see FIG. 3. The forward end of the forward lever arm 46 is thereby moved inwardly in the radial direction far enough to ensure that during the following rotary movement of the rotary knob 18 in a clockwise direction the face 71 does no longer get into contact with the section 59 so that the rotary movement of the rotary knob 18 is no longer obstructed. As soon as the forward lever arm 56 enters that area of the groove 26 where the radially outwardly projecting concentrical portion 53 follows the concentrical portion 60, the lever 40 will be pivoted in counter-clockwise direction, relative to the disc 6, due to the contact between the rear lever arm 48 and the concentrical portion 60. This pivoting movement, which has no function in the embodiment shown, is partly reversed due to the fact that during the further rotation of the knob 18 the forward end of the forward lever arm 46 slides along the portion 63. The rear end 80 of the rear lever arm 48 is thereby moved radially outwardly a way sufficient to ensure when the shooter tries to turn the rotary knob 18 back, it comes into contact with the transition 62 of the guide cam 34 whereby any rotary movement in the reverse sense is prevented, as shown in FIG. 4.

As soon as the rear lever arm 48 passes the section 65 of the guide cam 34, shortly before the completion of a full rotation of the rotary knob 18, the lever 40 is pivoted again in counter-clockwise direction relative to the disc 6 so that the forward end of the forward lever arm 46 is moved radially outwardly to ensure that the face 71 of the forward lever arm 46 comes into contact with the section 59. However, before this situation occurs, the lever 40, which for safety reasons had its forward end moved radially outwardly an additional way, will be moved radially inwardly by the section 57 until the position shown in FIG. 2 is reached.

The concentrical portions 52, 53 and 54 and/or the inner face 32 ensure in the example shown that the lever 40 cannot turn around or rotate far enough to get jammed. This objective may be achieved also by any other means of limiting the angle of rotation of the lever 40.

In the claims, the reference numerals and further explanations set in brackets are not a limitation of the scope, but shall facilitate understanding.

I claim:

1. Actuating mechanism for the cooking device of a self-loading hand gun, characterized in that an actuating element is rotatably seated therein, that two co-acting elements for limiting rotational movement of said actuating element are provided so as to stop movement of the actuating element after a predetermined angle of rotation along a predetermined sense of rotation, when said actuating element is moved manually in said predetermined rotation sense, that one of said co-acting elements is connected in driving relationship with said actuating element, while the other of said co-acting elements is secured against rotation, that said co-acting elements comprise a guide cam for coaction with forward and rear arms of a lever, and wherein said lever is arranged to pivot about an axis, said axis being movable along a circular path, that the guide cam includes a first portion forming a stop for the forward lever arm, as viewed in said predetermined sense of rotation, when said forward lever arm has moved past said predetermined angle of rotation, that the guide cam includes a second portion spaced at a certain angular distance from said first portion along a rotation sense opposite to said predetermined rotation sense, that said second portion comes into contact with said rear lever arm so as to pivot said rear lever arm in one direction, when said lever is moved in a sense reverse to said predetermined rotation sense from a starting position, in which said forward lever arm rests against said first portion, so that said forward lever arm is subsequently moved in a direction opposite to said one direction by a distance sufficient to prevent said first portion from acting as a stop along said predetermined sense of rotation, thereby enabling said lever to be thereafter moved past said first stop in said predetermined sense of rotation.

2. The actuating mechanism according to claim 1, characterized in that said guide cam comprises at least one additional portion forming an other stop so as to prevent said lever from moving in said reverse sense after having passed said other stop during a movement of said lever in said predetermined sense.

3. The actuating mechanism according to claim 1, wherein said actuating element defines an axis, characterized by the circular path of said lever being arranged coaxially with the axis of said actuating element.

4. The actuating mechanism according to claim 1, characterized by said lever being seated on a part, said part being connected with said actuating element for rotation therewith.

5. The actuating mechanism according to claim 1, wherein said one direction is a radially outward direction, and wherein said direction opposite to said one direction is a radially inward direction.

6. The actuating mechanism according to claim 1, characterized in that said pre-determined angle of rotation is by a few degrees greater than 360°.

7. The actuating mechanism according to claim 2, characterized by the first, second, and other portions protruding radially inwardly.

* * * * *